US010772372B2

(12) United States Patent
O'Connor et al.

(10) Patent No.: US 10,772,372 B2
(45) Date of Patent: Sep. 15, 2020

(54) STOWABLE HOOD FOR APPAREL

(71) Applicant: VANS, INC., Costa Mesa, CA (US)

(72) Inventors: Colin Carroll O'Connor, Aliso Viejo, CA (US); Kristopher David Bergeron, Costa Mesa, CA (US); Joshua Erik Bridgeman, Costa Mesa, CA (US)

(73) Assignee: Vans, Inc., Costa Mesa, CA (US)

( * ) Notice: Subject to any disclaimer, the term of this patent is extended or adjusted under 35 U.S.C. 154(b) by 135 days.

(21) Appl. No.: 15/906,928

(22) Filed: Feb. 27, 2018

(65) Prior Publication Data

US 2019/0261718 A1 Aug. 29, 2019

(51) Int. Cl.
*A42B 1/04* (2006.01)
*A41D 3/02* (2006.01)

(52) U.S. Cl.
CPC ..... *A42B 1/048* (2013.01); *A41D 3/02* (2013.01); *A41D 2200/20* (2013.01)

(58) Field of Classification Search
CPC ..... A42B 1/048; A41D 3/02; A41D 2200/20
See application file for complete search history.

(56) References Cited

U.S. PATENT DOCUMENTS 1,592,562 A * 7/1926 Graham ..... A41D 7/008 2/84
1,908,288 A * 5/1933 Friedman ..... A41D 3/00 2/84
2,036,609 A * 4/1936 Rosen ..... A41D 3/04 2/84
2,072,644 A * 3/1937 McBee ..... A41D 3/04 2/84
2,102,251 A 12/1937 Morris
2,129,454 A * 9/1938 Wilkie ..... A41D 3/00 2/84

(Continued)

OTHER PUBLICATIONS

International Search Report and Written Opinion in PCT Application No. PCT/US2019/018569, dated May 8, 2019, 9 pages.

*Primary Examiner* — Shaun R Hurley
*Assistant Examiner* — Bao-Thieu L Nguyen
(74) *Attorney, Agent, or Firm* — Ganz Pollard, LLC

(57) ABSTRACT

A hood for a garment. As assembled, the garment includes a covering for a torso portion of an intended user. The torso portion includes a back section that includes at least two panels defining an interstitial space for stowing a flattened hood. The hood assembled to the garment includes one or more panels of drapable sheet material configured to cover an intended user's head. The hood has a body having one or more perimetrical edges defining a facial area 11 configured to expose a predetermined portion of an intended user's face. The hood has a top section, with downwardly extending back and side sections. The hood is flattenable, without folding, rolling, creasing, crumpling, etc. so as to either not (1) reduce the length or width of the hood relative to an intended donned state or (2) substantially overlap materials in the flattened state. The hood is anchored to the torso portion along a back perimetrical edge of the hood to at least one of the torso portion panels. The panels include an opening for receiving the hood into the interstitial space, the interstitial space being configured to receive and stow the hood in the flattened state.

23 Claims, 3 Drawing Sheets

(56) References Cited

U.S. PATENT DOCUMENTS 2,136,380 A * 11/1938 Garrison ..... A41D 3/00 2/84
2,136,393 A * 11/1938 Nelson ..... A41D 3/04 2/84
2,150,171 A 3/1939 Kolly
2,368,654 A * 2/1945 Frank ..... A41D 3/00 2/94
2,507,322 A * 5/1950 Smith ..... A41D 3/00 2/97
2,631,289 A * 3/1953 Herrington ..... A41D 3/00 2/84
2,682,056 A 6/1954 Werber
2,735,283 A * 2/1956 Schuessler ..... A42B 1/045 2/202
3,187,344 A * 6/1965 Porcello ..... A41D 3/00 2/93
4,110,846 A * 9/1978 Hernandez ..... A41D 23/00 2/203
4,426,740 A 1/1984 Reververi
4,771,479 A 9/1988 Silver
5,119,510 A * 6/1992 Schilling ..... A01K 55/00 2/202
5,274,850 A 1/1994 Aldridge
5,718,000 A 2/1998 Ost et al.
5,794,263 A 8/1998 Carman
6,665,878 B1 12/2003 Way
6,789,266 B1 * 9/2004 Mills ..... A42B 1/045 2/172
D675,810 S 2/2013 Bridges
2004/0187186 A1 9/2004 Boezi
2009/0031472 A1 2/2009 Gandy
2009/0181599 A1 * 7/2009 Farmer ..... A41B 1/08 450/39
2009/0241235 A1 10/2009 Weinreb
2013/0007940 A1 * 1/2013 Ryerson ..... A47G 9/068 2/80
2016/0165975 A1 * 6/2016 Reuben ..... A41D 15/04 2/69.5
2018/0280184 A1 * 10/2018 Zhu ..... A61F 5/05883

* cited by examiner

STOWABLE HOOD FOR APPAREL

BACKGROUND

The inventive subject matter is generally directed to hoods for apparel or garments, such as jackets, parkas, windbreakers, shells, sweaters, jumpsuits, etc. (As used herein, "apparel" and "garments" are synonymous, interchangeable terms.)

Outdoor wear that covers a user's upper torso often includes a hood for covering the top, back, and sides of the intended user's head. Hoods for outerwear are known to come in various forms. In conventional hooded garments, the hood may be permanently or removably affixed to the garment. Removable hoods may attach to a garment via a fastener system like a zipper, hook-and-loop fastener, snaps, buttons, magnets. A lower perimeter portion of the hood has one part of the system that mates with another part disposed on the garment, typically the collar or upper shoulder region of the garment.

The garment may also include a hood stowage system. In some garments, the hood may be folded, rolled up, or otherwise stuffed and stowed in a pocket or channel formed in the collar of the garment. In other garments, a pocket is associated with the upper back panel of the garment, allowing the hood to be stuffed therein. Examples of such known approaches include U.S. Pat. Nos. 6,665,878 and 2,150,171.

In the conventional stowage systems, the folding, rolling, stuffing of the hood compacts the hood to fit a relatively small stowage area, bulking the garment in that area. The added bulk can be uncomfortable to the user. It also may diminish the aesthetics of the garment.

Accordingly, there is a need for improved hood and stowage systems that do not add bulk and preserve a garment's comfort and/or aesthetics. There is also a need for hoods and stowage systems that allow for a variety of hood configurations and easy stowage and deployment.

SUMMARY

The inventive subject matter addresses the foregoing and other needs. The following embodiments are representative of how the inventive subject matter can address such needs.

The inventive subject matter is generally directed to a garment with (1) an affixed or removable hood and (2) a stowage system for the hood. The hood and garment are configured to allow for a flat, non-bulky stowage of the hood, which does not compromise the aesthetics of the garment. In some embodiments, the inventive subject matter advantageously eliminates the need for special pockets or collars, simplifying the construction of the garment.

In one possible embodiment, the inventive subject matter is directed to a novel flattenable hood for a garment. As assembled, the garment includes a covering for a torso portion of an intended user. The torso portion includes a back section that includes at least two panels defining an interstitial space for stowing a flattened hood. The hood assembled to the garment includes one or more panels of drapable sheet material configured to cover an intended user's head. The hood has a body having one or more perimetrical edges defining a facial area configured to expose a predetermined portion of an intended user's face. The hood has a top section, with downwardly extending back and side sections. The hood is flattenable, without folding, rolling, creasing, crumpling, etc. so as to either not (1) reduce the length or width of the hood relative to an intended donned state or (2) substantially overlap materials in the flattened state. The hood is anchored to the torso portion along a back perimetrical edge of the hood to at least one of the torso portion panels. The panels include an opening for receiving the hood into the interstitial space, the interstitial space being configured to receive and stow the hood in the flattened state.

The hood may include a pair of flaps that are couplable and serve as a neck covering. One flap extends from a front edge of one of the side sections, and the other flap extends from the front edge of the other side section. The flaps may stow in the hood stowage in a flattened state without overlapping the body of the hood.

In some embodiments, the inventive subject matter is directed to hood that includes one or more panels of drapable sheet material configured to cover an intended user's head, the hood having a body comprising one or more perimetrical edges defining a facial area configured to expose a predetermined portion of an intended user's face, the hood having a top section with downwardly extending back and side sections; the hood including a pair of flaps, one flap extending from a front edge of one of the side sections, and the other flap extending the front edge of the other side section; and wherein the top, side, and back sections flatten to a flattened body portion, and any overlapping portions of the hood do not cover more than 30% of the flattened body portion.

In the foregoing and other embodiments, in the flattened state, a facial portion of the hood may overlap a flattened body portion, the overlapping portion being defined by the perimeter of the facial opening overlapping with a flattened body portion via a single continuous crease that is partially concentric with the perimeter of the facial opening, the overlapping portion lying flat against the body portion without any creases or folds running between the perimeter and the continuous crease that is partially concentric with the facial opening.

In the foregoing and other embodiments, the overlap of the facial portion may not cover more than 30% of the area of the flattened body portion.

In the foregoing and other embodiments, the flaps may be configured to adjustably couple together.

In the foregoing and other embodiments, the hood may include a seamed dart extending rearwardly from the top section, the seamed dart, merging into a longitudinal seam that extends to a lower perimetrical edge on the back section of the hood, the hood being constructed from a flat, drapable sheet of material configured with a dart that becomes the seamed dart.

In another possible embodiment, the inventive subject matter is directed to a garment, that includes a covering for a torso portion of an intended user, the torso portion including a back section comprising at least two vertically oriented, parallel back panels configured to cover an intended user's back and defining an interstitial space between the panels; a hood, comprising one or more panels of drapable sheet material configured to cover an intended user's head, the hood having a body comprising one or more perimetrical edges defining a facial area configured to expose a predetermined portion of an intended user's face, the hood having a top section with downwardly extending back and side sections, the hood being flattenable, without folding, rolling, or crumpling so as to either (1) not reduce the length or width of the hood relative to an intended donned state or (2) substantially overlap materials in the flattened state; and wherein the hood is anchored along a back perimetrical edge of the hood to one of the torso portion back panels, the back panels including an opening for receiving the hood into the interstitial space, the interstitial space being configured to receive and stow the hood in the flattened state.

In the foregoing and other embodiments, the hood may include flaps extending from the front of the hood that are configured to adjustably couple together and are configured to cover the front neck of the intended user.

In the foregoing and other embodiments, the interstitial space may be defined in part by a panel comprising the back, body-facing panel of the garment.

In the foregoing and other embodiments, the opening may consist of a closable slot disposed along the junction of a collar on the garment and the body of the garment.

In another possible embodiment, the inventive subject matter is directed to a method of making a hood that includes the steps of providing a pattern in which a filleted hood is defined or definable, the pattern including a dart section, the pattern including seam lines that when joined provide for a drapable sheet material to take the three-dimensional form of a hood, the hood having a body comprising one or more perimetrical edges defining a facial area configured to expose a predetermined portion of an intended user's face, the hood having a top section with downwardly extending back and side sections, the hood including a pair of flaps, one flap extending from a front edge of one of the side sections, and the other flap extending the front edge of the other side section, the top, side, and back sections being flattenable to a flattened body portion and any overlapping portions of the hood do not cover more than 30% of the flattened body portion; providing one or more panels of flat drapable sheet material; using the pattern to produce the filleted hood; and joining the seam lines in the filleted hood to produce the three-dimensional hood.

In the foregoing and other embodiments, the method may include the step of attaching the produced hood to a garment.

In the foregoing method and other embodiments, the hood may be attached at an opening to an interstitial space or pocket in the garment, the interstitial space or pocket being configured to receive and stow the hood in a flattened state.

In the foregoing method and other embodiments, the opening may be a closable slot disposed at the junction of a collar and the body of the garment.

In the foregoing and other embodiments, the slot may be at least 5 cm wide.

In the foregoing and other embodiments, the hood in the flattened condition and the interstitial space may be at least 10 cm long and/or it may be at least 10 cm wide.

Other embodiments are contemplated in the Detailed Description below, the appended Figures, and in the claims, as originally written or amended, the claims as such being incorporated by reference into this Summary. The foregoing is not intended to be an exhaustive list of embodiments and features of the inventive subject matter. Persons skilled in the art can appreciate other embodiments and features from the following detailed description in conjunction with the drawings.

BRIEF DESCRIPTION OF THE DRAWINGS

The following figures.

FIG. 1 shows a front view of hood attached to a garment (partial view of an upper portion of the garment).

FIG. 2 is a left side perspective view of the hood of FIG. 1.

FIG. 3 is a right side perspective view of the hood of FIG. 1.

FIG. 4 is a right side perspective view of the hood of FIG. 3 in a stowed position between panels of the garment.

FIG. 5 is plan view of the preassembly pattern for the hood of FIG. 1.

FIG. 6 shows an isolated front view of the collar of a garment and a closeable slot for accessing a stowage space in the garment (partial view of the upper portion of the garment).

DETAILED DESCRIPTION

Figure 1:
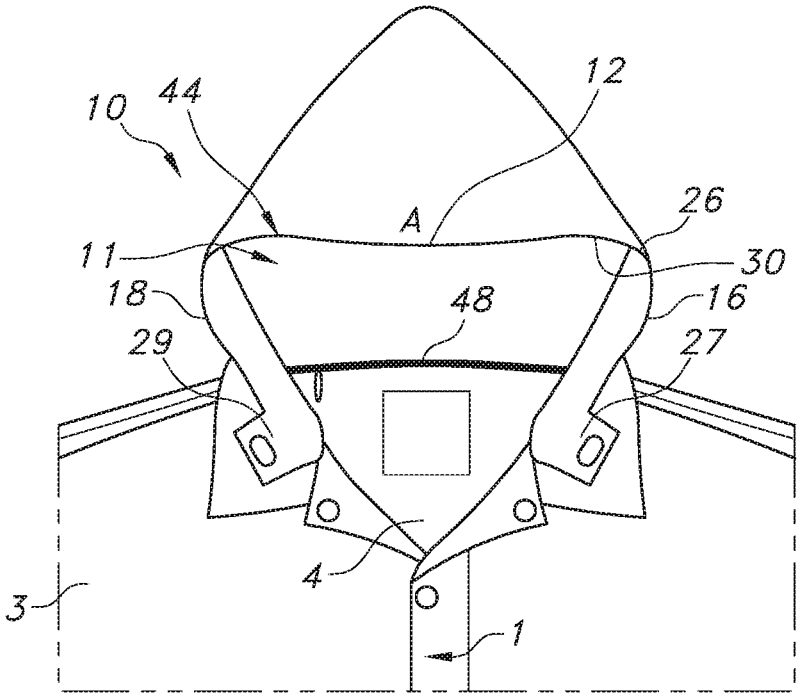
FIGS. 1-6 show one possible embodiment according to the inventive subject matter, unless noted as showing prior art. The figures presented are for illustrative and explanatory purposes and are not necessary in scale.

Representative embodiments according to the inventive subject matter are shown in FIGS. 1-6 and described herein, wherein the same or generally similar features sharing common reference numerals.

The inventive subject matter is generally directed to a garment 1 with an affixed or removable hood 10 and a stowage space for the hood.

In certain embodiments, the hood is configured to stow in a flattened state that does not add appreciable bulk to the garment. The hood is formed from a novel pattern that is configured to allow the hood to have a flattened state after edges in the pattern are joined. The stowage area is sufficient to allow the hood to be stored in the flattened state, without folding, rolling, stuffing or other bulk-creating reduction in form. The stowage area may be the interstitial space 2 between selected panels in the garment, such as an exterior-facing panel 3 and body-facing panel 4. Accordingly, the need for special stowage pockets or collars is eliminated, simplifying the construction of the garment.

In general, as used herein, a hood is a head covering made of a drapable sheet material configured to cover an intended user's head area, leaving a facial area exposed. The body of the hood includes a plurality of anatomical zones for covering the top, sides, and back of the head, in whole or part. The amount of exposed facial area may vary depending on the application. For example, if a garment is intended for milder environs, more of the face may be exposed at facial opening 11. The exposed facial area may vary. For example, it may expose most of a wearer's forehead, cheeks, jaw and neck. If a garment is intended for harsh winter climates, the hood may expose minimal face area, such as just the eyes and nose. Of course, a hood may have an adjustable face opening, e.g., a draw string around the perimeter of the opening, to allow for a full range of adjustments.

The hood may attach to a jacket or other garment at the back of the neck/shoulder area and thereby include coverage of at least the back of the neck. In some embodiments, the hood may wrap around the sides of the neck. In some embodiments, it may extend further, so that it encircles the neck. In general, such an embodiment would be in the form of connectable flaps that are couplable at the front of the neck to complete the encircling. The flaps may include known closures such as hook-and-loop fasteners, zippers, snaps, buttons, or magnets. Alternatively, a neck covering could be a baklava style covering integrated with the hoods that fully encircles the neck and does not have flaps that separate to fit around the neck. Instead it slips over the user's head and down over the neck.

Example hood materials include natural and synthetic textiles like Nylon, polyester, rayon, acrylic, elastane, cotton, wool, linen, leather, silk, bamboo, hemp, and combinations of the foregoing, either as blends, laminates, or sequentially joined materials. The hood may include functional sheet materials and coatings, such as waterproof and breathable membranes, e.g., expanded PTFE; wicking layers; insulation layers or fill materials; functional coatings, e.g., water or soil repellents; flame retardants; and reflective coatings.

The hood may be made of one or more plies of sheet material. The plies may be a single, integral ply of one or more materials. Or they may overlap in whole or part to form an integral laminate of plies. For example, the entire hood may be a laminate, or select areas could be a laminate, of one or more plies of the same or different sheet materials. As one example, the hood could have an outer layer of a durable material such as nylon or polyester and an inner or intermediate layer of a waterproof breathable film. An inner or intermediate layer could also be a moisture-wicking layer or an insulating layer. The hood could have multiple plies in just the top-of-head area to provide more insulation, with sides in a single ply to allow for selective cooling.

In addition to plies of material, the hood could be configured with baffles or chambers for holding an insulating fill material, such as natural or synthetic down or batt insulation.

Looking at FIGS. 1-5, the hood 10 is a head covering that can consist of a plurality of anatomical sections. The sections correspond to anatomical zones of the head. They may be definable in a single structure of sheet material configured to cover a head or they may be definable in two or more discrete panels of sheet that are joined together to form a head covering.

Top section 12 covers the top portion of the head, between the forehead and crown. Accordingly, the top section has a generally horizontal orientation relative to the user's head. Several side sections extend downwardly from the top section to complete a covering that covers the user's head, except for selected area of the face. The top section may have an perimetrical edge that extends to just above a user's forehead and/or temples or it may extend to user's brow and/or outer corners of the eye orbits.

Back section 14 covers the back (generally, the crown and nape) of the user's head. The lower edge of the back section is permanently or removable affixed to a garment. The lower edge accordingly will extend over the user's neck, to the shoulder region, as well as the back side of the head.

Side sections 16, 18 extend downwardly from top section 12 and laterally from back section 14, covering the area from the back of the user's head to the facial area 11. These sections may also extend over the user's neck. They may also partially extend into the facial area to cover a user's jaw, chin, mouth, and/or nose. The downward extent of the side sections may be varied from terminating above a user's ears, to covering just over the user's ears, to covering just below the jaw line, to covering some or all of the neck.

The detached hood has a plurality of edges defining the perimeter of the hood. Back section 14 includes a perimetrical edge section 20 that anchors or integrates with the garment. Side sections 16, 18 have generally horizontal perimetrical edge sections 22, 24 that may be unattached to the garment and tuck inside or over the collar of a garment. Those edge sections may be continuous with edge section 20. The side sections also have generally vertical perimetrical edge sections 26, 28 that define part of the exposed facial area 11, in combination with a front, generally horizontal perimetrical edge 30 of top section 12. Again, these sections 26, 28, 30 may form a continuous edge. A drawstring channel and draw string (not shown) may be associated with these edges to provide for a facial area that has adjustable facial coverage.

Figure 5:
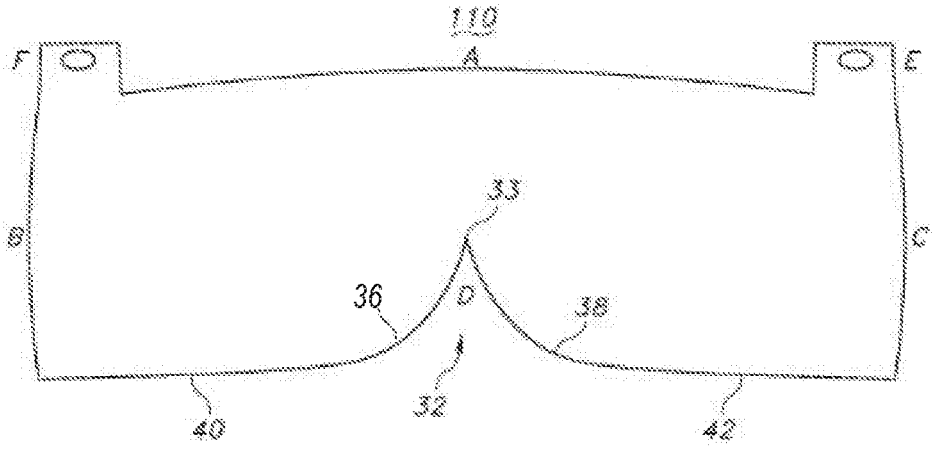
Figure 6:
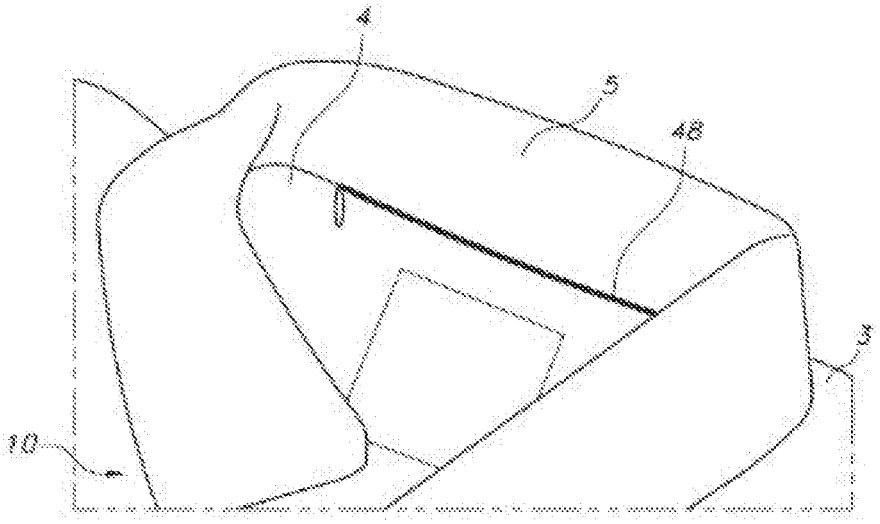

FIG. 5 shows a pattern 110 for producing hood 10 that can store in a flattened state. The pattern may be a planar sheet of one or more plies of material in which or onto which the preassembled configuration of a hood, as described above, in defined. The configuration can be physically marked on the hood material, e.g., ink printed or it can be virtually imposed, e.g., a digitally stored image for controlling a cutting machine or a laser or light image for guiding a cutting machine.

The pattern has a somewhat rectangular form. Long sides A and D are generally parallel, except for an indented "dart" 32 formed in the middle of side D, and optional flaps or extensions E, F extending off the opposing end portions of section A.

As known in the sewing arts, darts are indentations in a flat fabric that allow the flat fabric to conform to the contours in a body by joining the sides of the dart. Darts typically have at least one apex. The dart of FIG. 5 has an apex end 33, which outwardly tapers to an opposing opening.

Still looking at FIG. 5, short sides B and C are generally parallel and interconnect with sides A and D. Dart 32 has a generally triangular-like or pie-like shape, with the apex 33 indenting about halfway into the space between lines A and D. In assembly, the opposing legs 36, 38 of the triangular dart structure are joined together to form a seam. There may be a slight curvature of the legs as they merge into opposing sections 40, 42 of side D. The joining continues along those opposing sections. The joining of the dart and the opposing sections converts the flat pattern into a seamed configuration that can three-dimensionally conform around a user's head. The aforementioned curvature of the legs facilitates creating a head conforming shape. Also, as seen in the FIG. 5, line A may have a shallow convex curvature to facilitate such conformation.

The pattern may be considered a filleted configuration, with the dart 32 at the centerline, defining mirrored halves, with each half of line D folding onto itself and then being joined together, creating a seam. Any number of known or to be discovered joining techniques may be used, including, stitching, adhesive bonding, thermal fusion or welding, mechanical fastening, e.g. zippers or hook-and-loop fasteners.

The dart allows for a rounded, contoured shape running from the top of the head (top section 12) and down and around the back of the head (back section 14). The size and shape of the dart may be varied to provide other desired rounded shapes, as persons skilled in the art will appreciate.

From the foregoing, it can be appreciated that a hood according to the inventive subject matter can leave a range of head, neck, and facial areas exposed when donned.

FIGS. 1-4 shows the patterned hood material after assembly. Line D from the pattern runs from about the center of top section 12, in alignment with the apex of the dart in the center of line D, to the center of horizontal, perimetrical section 20. Line A forms horizontal and vertical perimetrical sections 26, 28, and 30, defining some or all of the exposed facial area 11 of the hood. Lines E and F of the optional flaps 27, 29 may further define the exposed facial area and also provide coverage over the user's neck. The flaps may have closures that allow the edge portions of the flaps to join. Once joined the flaps cover the user's neck and their top edges define the lower portion of the exposed facial area. The flaps may be configured in varying sizes so that they can cover a desired area of the neck or face. For example, flaps 27, 29 can be made wider so that they can cover the user's mouth and lower cheeks.

Figure 2:
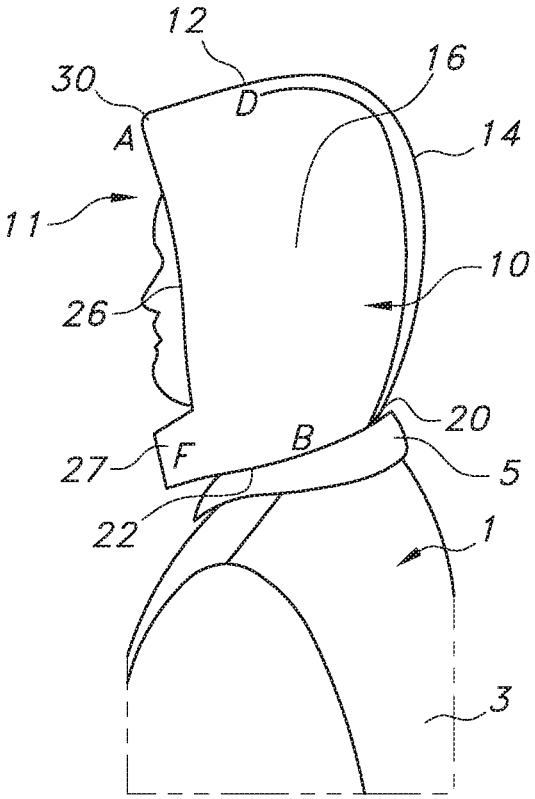
Figure 3:
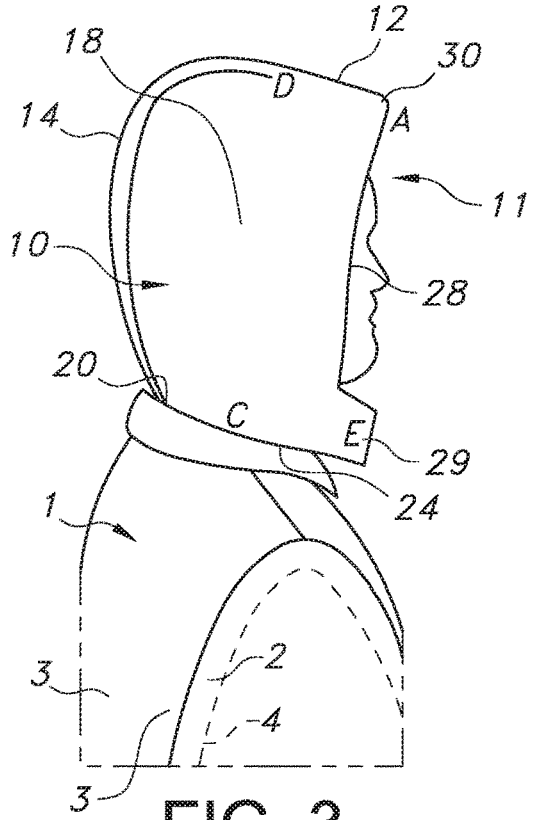
Figure 4:
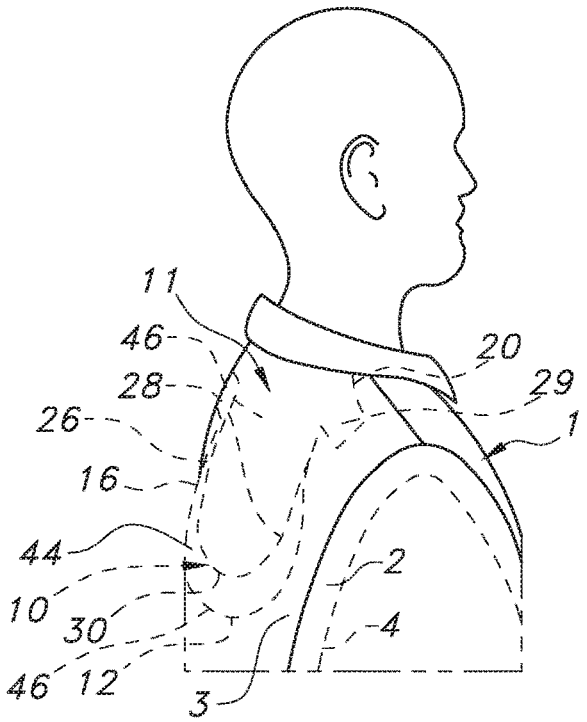

FIGS. 2-3 show the hood in the donned state. FIG. 4 shows the hood in a flattened state, which is how it can rest in the stowage area, or outside the stowage area. As used herein, a "flattened state" (and like references) means a planar shape, one where there are no appreciable folds or creases placed over the surface of the object to flatten it and reduce its dimensions, and disregarding any incidental wrinkling normal to the fabric or textile forming the object. The filleted pattern described above produces a hood that can be flattened without folding, rolling, or crumpling of the hood material to reduce its dimension. In the flattened state, the length and width of the inventive hood are not reduced. If they were to be, it would necessarily result in bulking of material. According to the inventive subject matter, the length and width of the hood remain the same or may increase. As can be seen in FIG. 4, the length of the flattened hood, as measured from at or about the center of section 12 to the level of edge 20 at the bottom of back section 14, is the same or substantially the same as it is in the donned state (FIGS. 2-3). Similarly, the exposed facial area is the same or wider in comparison to the exemplary donned configuration shown in FIGS. 2-3. However, the hood may become somewhat wider as the side sections spread outwardly during flattening.

The flattened hood may have a small section 44 at the top front of the hood where line A, defining the facial opening overlies the flattened body of the hood, which flattened portion includes top section 12, rear section 14, and side sections 16, 18. The top of section 44 is a portion of the hood that may extend downwardly over the forehead area of a user. As can be seen, overlapping section 44 may taper downwardly as it approaches edges 22, 24. The overlap produces a single, continuous crease 46 that generally parallels the perimeter of the facial opening, at least at the top of the opening, before the crease tapers inwardly as it approaches sections 22, 24. In other words, the crease is partially concentric with the perimeter of the facial opening. The crease 46 allows the overlapping area 44 to lie flat against the flattened body portion of the hood. Aside from this perimetrical crease, there are no other creases or folds necessary to flatten the hood.

In conventional hoods, a flattening of the hood may produce creases or folds that run perpendicular or transverse to the perimeter of the facial opening, creating bulk. The flattening may require the top front perimetrical edge to overlap well into the facial opening area and over the flattened body portion, bulking up that area and substantially covering it and shortening the length of the hood. In the inventive subject matter, the overlap is minor and does not result in a substantial change in the length of the hood or coverage of the facial opening. Furthermore, the overlap is achieved without folding, rolling, or crumpling of the hood. In other words, in the flattened state, the overlap hood does substantially overlap with and cover the flattened body portion. As used herein, "substantially" means that less than 30% of the area of the flattened body portion is covered by the overlapping section, which may have a crease that parallels the perimeter of the facial opening, as described above. In some embodiments, less than 25% of the flattened body portion is overlapped by other hood material. In some embodiments, less than 20% of the flattened body portion is overlapped by other hood material. In some embodiments, less than 15% of the flattened body portion is overlapped by other hood material. In some embodiments, less than 10% of the flattened body portion is overlapped by other hood material.

Looking at FIG. 4, the interstitial space 2 between panels or layers 3, 4 may be of varying dimensions provided it has an area sufficient to hold the hood in its flattened state. It can be seen in FIG. 4 that side flaps 27, 29 store flat, without overlapping the flattened body portion of the hood. To facilitate placement of the flattened hood in the interstitial space, an opening slot 48 leading to the space can be made wide enough for the intended user's hand or fingers to fit in so that the hood can be stuffed into the space in a flat condition. A suitable slot may be at least 5 cm long.

Dimensions of the hood may vary, depending on the intended user's size. In general, hoods may be at least 10 cm long and at least 10 cm wide (at widest point) in the flattened state, excluding any side extensions F and E. The interstitial space should therefore have dimensions at least as wide and long as the flattened hood to be received in the space, i.e. the space may provide a storage of at least 10 cm long and at least 10 cm wide. While the interstitial space may be the space between panels of the garment, i.e., the layers or panels corresponding to the back-torso portion of a garment, the space may also be a pocket formed on any such layer or panel that has a length or width sufficient to hold a hood in the flattened state.

In one possible embodiment, perimetrical edge section 20 may be anchored to the garment at the inside (body-facing) junction of the collar 5 and the body of the garment. The opening 48 into the interstitial space may include a zipper or other selectively closable closure. The inside junction line allows for the slot to be hidden so as not to upset the aesthetics of the garment. Notably, in contrast to hoods that attach to the outside of collars and stow rolled up in the collars, an inside anchoring position in combination with stowage in an interstitial space in the body of the jacket, does not cover the outside of the collar, preserving the aesthetic of the collar when the hood is deployed, and eliminating bulk from the collar, when the hood is stowed.

While the slot to the interstitial space in the body of the garment may be on the inside surface of a garment, there is no reason why it could not be on an outside surface, e.g., the shoulder or collar area of the back-exterior panel of the jacket.

Although not shown, the hood may include a visor for extending over and shading the facial area.

As persons skilled in the art will appreciate, the embodiment shown in the Figures is just one of many possible embodiments of the inventive subject matter, and it is not intended to be limiting.

Terminology and Scope

Persons skilled in the art will recognize that many modifications and variations are possible in the details, materials, and arrangements of the parts and actions which have been described and illustrated to explain the nature of the inventive subject matter, and that such modifications and variations do not depart from the spirit and scope of the teachings and claims contained therein.

The principles described above about any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be plain to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

If and as used herein the terms "part", "portion", "segment", "region," "zone," "section" and like terms are generally synonymous terms and do not imply that something is or is not a discrete element or subcomponent in a larger construct or is or is not a non-discrete subdivision of a larger unitary construct, unless context indicates otherwise.

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

Each named inventor and the applicant reserve all rights to the subject matter disclosed herein, including the right to claim all that comes within the scope and spirit of the claims appended below.

The invention claimed is:

1. A hood, comprising:

one or more panels of drapable sheet material configured to cover an intended user's head, the hood having a body comprising one or more continuous perimetrical edges defining a facial area configured to expose a predetermined portion of an intended user's face, the hood having a top section above the defined facial area with downwardly extending back and two side sections, wherein the back section is disposed on an opposing side of the top section from the defined facial area, and wherein a seamed dart that joins edges in the pattern forming the hood extends from an apex at about the center of the top section, which corresponds to the crown of a user's head, rearwardly down the back section thereby forming a rounded, contoured shape running from the top of the hood and down and around the back of the hood, wherein the seamed dart does not extend forward of the top section to the facial area;

the hood including a pair of flaps, one flap extending from a front edge of one of the side sections, and the other flap extending from the front edge of the other side section; and wherein, in a flattened state, donned in an inverted form against a user's back, the top, side, and back sections flatten to a flattened body portion, and a portion of the top section in planar shape overlaps a portion of the flattened body portion, wherein any overlapping portion of the top section does not cover more than 30% of the flattened body portion.

2. The hood of claim 1 wherein when the hood is in the flattened state, the flaps are flattenable without overlapping with the flattened body portion of the hood.

3. The hood of claim 1 wherein in the flattened state; the overlapping portion of the top section is defined by the perimeter of the facial area overlapping with the flattened body portion via a single, curved continuous crease that is partially concentric with the perimeter of the facial area.

4. The hood of claim 3 wherein the overlapping portion of the top section does not cover more than 30% of the area of the flattened body portion.

5. The hood of claim 1 wherein the flaps are configured to adjustably couple together and cover the front neck of the intended user.

6. The hood of claim 1 wherein the hood includes a seamed dart extending rearwardly from the top section, the seamed dart, merging into a longitudinal seam that extends to a lower perimetrical edge on the back section of the hood, the hood being constructed from a flat, drapable sheet of material configured with a dart that becomes the seamed dart.

7. A garment, comprising:

a covering comprising a torso portion configured to cover at least a portion of a torso of an intended user, the torso portion including a back section comprising at least two vertically oriented, parallel back panels configured to cover an intended user's back and defining an interstitial space between the panels, wherein a first one of the parallel back panels comprises a body-facing panel and a second one of the parallel back panels comprises an exterior-facing panel;

a hood, comprising one or more panels of drapable sheet material configured to cover an intended user's head, the hood having a body comprising one or more continuous perimetrical edges defining a facial area configured to expose a predetermined portion of an intended user's face, the hood having a top section above the defined facial area with downwardly extending back and side sections, wherein the back section is disposed on an opposing side of the top section from the defined facial area, and wherein a seamed dart extends from an apex at about the center of the top section, which corresponds to the crown of a user's head, rearwardly down the back section thereby forming a rounded, contoured shape running from the top of the hood and down and around the back of the hood, wherein the seamed dart does not extend forward of the top section to the facial area, the hood being flattenable such that via a single curved crease disposed between the top of the back section and the perimetrical edge defining the facial area, a portion of the top section overlaps a portion of a flattened body portion, both the overlapping portion of the top section and the overlapped body portion being in a flattened state so as to not reduce the length or width of the hood relative to an intended donned state; and wherein the hood is anchored along a back perimetrical edge of the hood to the exterior-facing panel, the vertically oriented, parallel back panels defining an opening accessible from the body-facing side of the back section for receiving the hood into the interstitial space, the interstitial space being configured to receive and stow the hood in the flattened state.

8. The garment of claim 7 wherein in the flattened state the overlapping portion of the top section is defined by the perimeter of the facial area overlapping with the flattened body portion via a single, curved continuous crease that is partially concentric with the perimeter of the facial area.

9. The garment of claim 8 wherein the overlapping portion of the top section does not cover more than 30% of the area of the flattened body portion.

10. The garment of claim 9 wherein the hood includes flaps extending from the front of the hood that are configured to adjustably couple together.

11. The garment of claim 10 wherein the flaps are configured to cover the front neck of the intended user.

12. The garment of claim 11 wherein when the hood is in the flattened state, the flaps are flattenable without overlapping with the body of the hood.

13. The garment of claim 11 wherein the interstitial space is defined in part by the panel comprising the back, body-facing panel of the garment.

14. The garment of claim 11, wherein the opening comprises a closable slot disposed along the junction of a collar on the garment and the body of the garment.

15. The hood of claim 7 wherein the seamed dart merges into a longitudinal seam that extends to a lower perimetrical edge on the back of the hood, the hood being constructed from a flat sheet of material configured with a dart that became the seamed dart.

16. The garment of claim 7 wherein a position of the opening accessible from the body-facing side of the back section is configured with respect to a collar such that the hood does not cover an exterior-facing side of the collar when the hood is in a deployed configuration.

17. A hood, comprising:

one or more panels of drapable sheet material configured to cover an intended user's head, the hood having a body comprising one or more continuous perimetrical edges defining a facial area configured to expose a predetermined portion of an intended user's face, the hood having a top section above the defined facial area with downwardly extending back and two side sections, wherein the back section is disposed on an opposing side of the top section from the defined facial area, and wherein sections are joined at a seamed dart that extends from an apex at about the center of the top section rearwardly down the back section thereby forming a rounded, contoured shape running from the top of the hood and down and around the back of the hood, wherein the seamed dart does not extend forward of the top section to the facial area; and wherein, in a flattened state, donned in an inverted form against a user's back, the top, side, and back sections flatten to a flattened body portion, and a portion of the top section overlaps a portion of the flattened body portion, both the overlapping portion of the top section and the overlapped body portion being in a flattened state, wherein any overlapping portions of the top section does not cover more than 30% of the flattened body portion.

18. A hood, comprising one or more panels of drapable sheet material configured to cover an intended user's head, the hood having a body comprising one or more continuous perimetrical edges defining a facial area configured to expose a predetermined portion of an intended user's face, the hood having a top section above the defined facial area with downwardly extending back and side sections, wherein the back section is disposed on an opposing side of the top section from the defined facial area, and wherein a seamed dart extends from an apex at about the center of the top section, which corresponds to the crown of a user's head, rearwardly down the back section thereby forming a rounded, contoured shape running from the top of the hood and down and around the back of the hood, wherein the seamed dart does not extend forward of the top section to the facial area, the hood being flattenable such that via a single curved crease disposed between the top of the back section and the perimetrical edge defining the facial area, a portion of the top section overlapping a portion of the body portion, both the overlapping portion of the top section and the overlapped body portion being in a flattened state when the hood is donned in an inverted form against a user's back, so as to not reduce the length or width of the hood relative to an intended donned state.

19. A method of making a hood, comprising:

providing a pattern in which a filleted hood is defined or definable, the pattern including a dart section, the pattern including seam lines that when joined provide for a drapable sheet material to take the three-dimensional form of a hood, the hood having a body comprising one or more continuous perimetrical edges defining a facial area configured to expose a predetermined portion of an intended user's face, the hood having a top section above the defined facial area with downwardly extending back and side sections, wherein the back section is disposed on an opposing side of the top section from the defined facial area, and wherein, when joined, the seam lines form a dart extending from an apex at about the center of the top section, which corresponds to the crown of a user's head, rearwardly down the back section thereby forming a rounded, contoured shape running from the top of the hood and down and around the back of the hood, wherein the seamed dart does not extend forward of the top section to the facial area, the hood including a pair of flaps, one flap extending from a front edge of one of the side sections, and the other flap extending the front edge of the other side section, wherein, in a flattened state, donned in an inverted form against a user's back, the top, side, and back sections flatten to a flattened body portion and wherein any overlapping portion of the top section does not cover more than 30% of the flattened body portion;

providing one or more panels of flat drapable sheet material;

using the pattern to produce the filleted hood; and joining the seam lines in the filleted hood to produce the three-dimensional hood.

20. The method of claim 19 further comprising attaching the produced hood to a garment.

21. The method of claim 20 wherein the hood is attached at an opening to an interstitial space or pocket in the garment, the interstitial space or pocket being configured to receive and stow the hood in a flattened state.

22. The method of claim 21 wherein the opening comprises a closable slot disposed at the junction of a collar and the body of the garment.

23. The method of claim 22 wherein the slot is at least 5 cm wide and the interstitial space or pocket is at least 10 cm long and at least 10 cm wide.

* * * * *